US009299357B2

(12) United States Patent
Lee et al.

(10) Patent No.: US 9,299,357 B2
(45) Date of Patent: Mar. 29, 2016

(54) APPARATUS AND METHOD FOR DECODING AUDIO DATA

(71) Applicant: SAMSUNG ELECTRONICS CO., LTD., Suwon (KR)

(72) Inventors: Kang Eun Lee, Hwaseong (KR); Do Hyung Kim, Hwaseong (KR); Chang Yong Son, Gunpo (KR); Shi Hwa Lee, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 128 days.

(21) Appl. No.: 14/157,157

(22) Filed: Jan. 16, 2014

(65) Prior Publication Data

US 2014/0297290 A1 Oct. 2, 2014

(30) Foreign Application Priority Data

Mar. 27, 2013 (KR) ..... 10-2013-0032900

(51) Int. Cl.

*G10L 19/002* (2013.01)
*G10L 19/16* (2013.01)
*G10L 19/035* (2013.01)

(52) U.S. Cl.

CPC ..... *G10L 19/173* (2013.01); *G10L 19/035* (2013.01)

(58) Field of Classification Search

CPC .... G10L 19/008; H04S 3/008; H04N 1/4052; G09G 2320/08; G09G 2340/02
USPC ..... 704/500; 381/2; 714/750, 775, 776
See application file for complete search history.

(56) References Cited

U.S. PATENT DOCUMENTS

| | | | | |
|---|---|---|---|---|
| 7,043,423 | B2 | 5/2006 | Vinton et al. | |
| 7,318,027 | B2 | 1/2008 | Lennon et al. | |
| 7,644,001 | B2 | 1/2010 | Schuijers et al. | |
| 8,214,223 | B2 * | 7/2012 | Thesing et al. | 704/500 |
| 2008/0033732 | A1 | 2/2008 | Seefeldt et al. | |
| 2011/0173008 | A1 | 7/2011 | Lecomte et al. | |
| 2012/0016680 | A1 | 1/2012 | Thesing et al. | |

FOREIGN PATENT DOCUMENTS

| | | |
|---|---|---|
| JP | 2001-518267 | 10/2001 |
| JP | 4174859 | 8/2008 |
| KR | 2000-0044777 | 7/2000 |
| KR | 10-2004-0060718 | 7/2004 |
| KR | 10-0917845 | 9/2009 |
| KR | 10-2012-0009150 | 2/2012 |

* cited by examiner

*Primary Examiner* — Charlotte M Baker
(74) *Attorney, Agent, or Firm* — Staas & Halsey LLP

(57) ABSTRACT

An apparatus and method for decoding audio data. The apparatus for decoding the audio data may perform block data unpacking by preferring a channel order to a block order from a bitstream, and perform dithering through preferring a block order to a channel order. Complexity in decoding may be reduced through integrating bitstream searching and the bock data unpacking, and a dithering error may be prevented through processing the block data unpacking and the dithering separately.

18 Claims, 14 Drawing Sheets

FIG. 3

| | blk0 | blk1 | blk2 | blk3 | blk4 | blk5 |
|---|---|---|---|---|---|---|
| ch0 | | | | | | |
| ch1 | | | | | | |
| ch2 | | | | | | |
| ch3 | | | | | | |
| ch4 | | | | | | |
| ch5 | | | | | | |

APPARATUS AND METHOD FOR DECODING AUDIO DATA

CROSS-REFERENCE TO RELATED APPLICATIONS

This application claims the priority benefit of Korean Patent Application No. 10-2013-0032900, filed on Mar. 27, 2013, in the Korean Intellectual Property Office, the disclosure of which is incorporated herein by reference.

BACKGROUND

1. Field

Example embodiments of the following disclosure relate to an apparatus and method for decoding audio data, and more particularly, to an apparatus and method that performs block data unpacking, through preferring a channel order to a block order from a bitstream, and that performs dithering through preferring a block order to a channel order.

2. Description of the Related Art

An audio bitstream transferred via digital broadcasting, such as a Blu-ray disc or a high-definition television (HDTV) may be generated through compressing audio data in a digital audio format. Improvements relating to a quality of audio data have led to the further development of the digital audio format.

In particular, as a sound quality is enhanced when compared to a sound quality having the same bit rate, a number of channels of digital audio data may be extended. As the number of channels is extended, a digital audio codec is transformed into a form of providing additional functions in order to process the digital audio data with an enhanced sound quality. As used herein, a digital audio codec for processing digital audio data of a previously known number of channels, for example, a 5.1 channel, refers to a general audio codec. Further, a digital audio codec for processing digital audio data through an extended number of channels, for example, a 10.1 channel and a 13.1 channel, refers to an enhanced audio codec.

For example, when the general audio code includes Dolby Digital, the enhanced audio codec may include Dolby Digital Plus. Dolby Digital Plus may perform a more enhanced additional function than Dolby Digital, such as, transient pre-noise processing, enhanced channel coupling, adaptive hybrid transform processing, and spectral extension.

A block allocated to a horizontal axis and a channel allocated to a vertical axis may exist in a frame of a bitstream to be processed by the enhanced audio codec. The enhanced audio codec may unpack a frequency value of the digital audio data from the bitstream. More particularly, the enhanced audio codec may perform bitstream searching that searches for a location at which a predetermined block commences from the bitstream. In a subsequent step, the enhanced audio codec may perform block data unpacking to unpack block information, such as an exponent and a mantissa, based on the location of the block extracted as a result of the bitstream searching.

In this instance, the enhanced audio codec may perform the bitstream searching and the block data unpacking sequentially via a plurality of modules, respectively. Although actual results to be extracted from the bitstream searching and the block data unpacking may differ, overlapping operations may exist. Accordingly, a decoding complexity for processing the bitstream via the enhanced audio codec may be reduced through integrating the overlapping operations.

Maintaining a resulting value to be consistent may be required, irrespective of a change in an operation of the enhanced audio codec, despite a change in a detailed operation of the enhanced audio codec in order to reduce the decoding complexity.

Accordingly, an improved apparatus and method for decoding audio is desired.

SUMMARY

The foregoing and/or other aspects are achieved by providing an apparatus for decoding audio data, the apparatus including a block data unpacker to unpack block data from a bitstream, and a dithering performer to perform dithering with respect to the unpacked block data.

The block data unpacker may unpack an exponent and a mantissa representing the block data from the bitstream.

The block data unpacker may unpack an exponent and a mantissa representing block data, through preferring a channel over a block in a frame configuring a bitstream.

The block data unpacker may unpack the block data, and the block data may represent a frequency bin on which dithering is to be performed.

The block data unpacker may store a predetermined value in a buffer for storing an unpacked mantissa in order to represent a frequency bin on which the dithering is to be performed.

The dithering performer may perform dithering through generating noise with respect to block data in which a "0" bit is allocated to a mantissa from among the unpacked block data.

The dithering performer may perform dithering, through preferring a block order over a channel order in a frame configuring a bitstream.

The dithering performer may determine whether a current block is a block to which dithering is to be applied, and when the current block is determined to be the block to which the dithering is to be applied, the dithering may be performed through assessing a mantissa of a plurality of frequency bins.

The foregoing and/or other aspects are achieved by providing a method for decoding audio data, the method including unpacking block data from a bitstream, and performing dithering with respect to the unpacked block data.

The unpacking of the block data may include unpacking an exponent and a mantissa representing the block data from a bitstream.

The unpacking of the block data may include unpacking an exponent and a mantissa representing block data, through preferring a channel over a block in a frame configuring a bitstream.

The unpacking of the block data may include unpacking the block data, and the block data may represent a frequency bin on which dithering is to be performed.

The unpacking of the block data may include storing a predetermined value in a buffer for storing an unpacked mantissa in order to represent a frequency bin in which the dithering is to be performed.

The performing of the dithering may include performing dithering by generating noise with respect to block data in which a "0" bit is allocated to a mantissa from among the unpacked block data.

The performing of the dithering may include performing dithering through preferring a block order over a channel order in a frame configuring a bitstream.

The performing of the dithering may include determining whether a current block is a block to which dithering is to be applied, and when the current block is determined to be the block to which the dithering is to be applied, performing the dithering through assessing a mantissa of a plurality of frequency bins.

The foregoing and/or other aspects are achieved by providing a non-transitory computer-readable medium in which a bitstream is recorded, wherein the bitstream is configured by a plurality of blocks represented by an exponent and a mantissa, the plurality of blocks is unpacked through preferring a channel order over a block order, and dithering is performed through preferring the block order over the channel order with respect to a frequency bin in which a "0" bit is allocated to the mantissa.

Regarding the non-transitory computer-readable medium, the dithering may be performed by preferring the block order over the channel order with respect to a frequency bin in which a "0" bit is allocated to the mantissa.

Further, when an exponent of a previous block is determined to be reused, then the exponent of the previous block may be copied to an exponent of a current block.

Moreover, a decoding error due to dithering may be prevented by separating the block data unpacking and the dithering for processing based on different priority orders.

Additional aspects of embodiments will be set forth in part in the description which follows and, in part, will be apparent from the description, or may be learned by practice of the disclosure.

BRIEF DESCRIPTION OF THE DRAWINGS

These and/or other aspects will become apparent and more readily appreciated from the following description of embodiments, taken in conjunction with the accompanying drawings of which:

FIG. 3 illustrates a block-channel structure to be applied to an apparatus for decoding audio, according to example embodiments;

DETAILED DESCRIPTION

Figure 1:
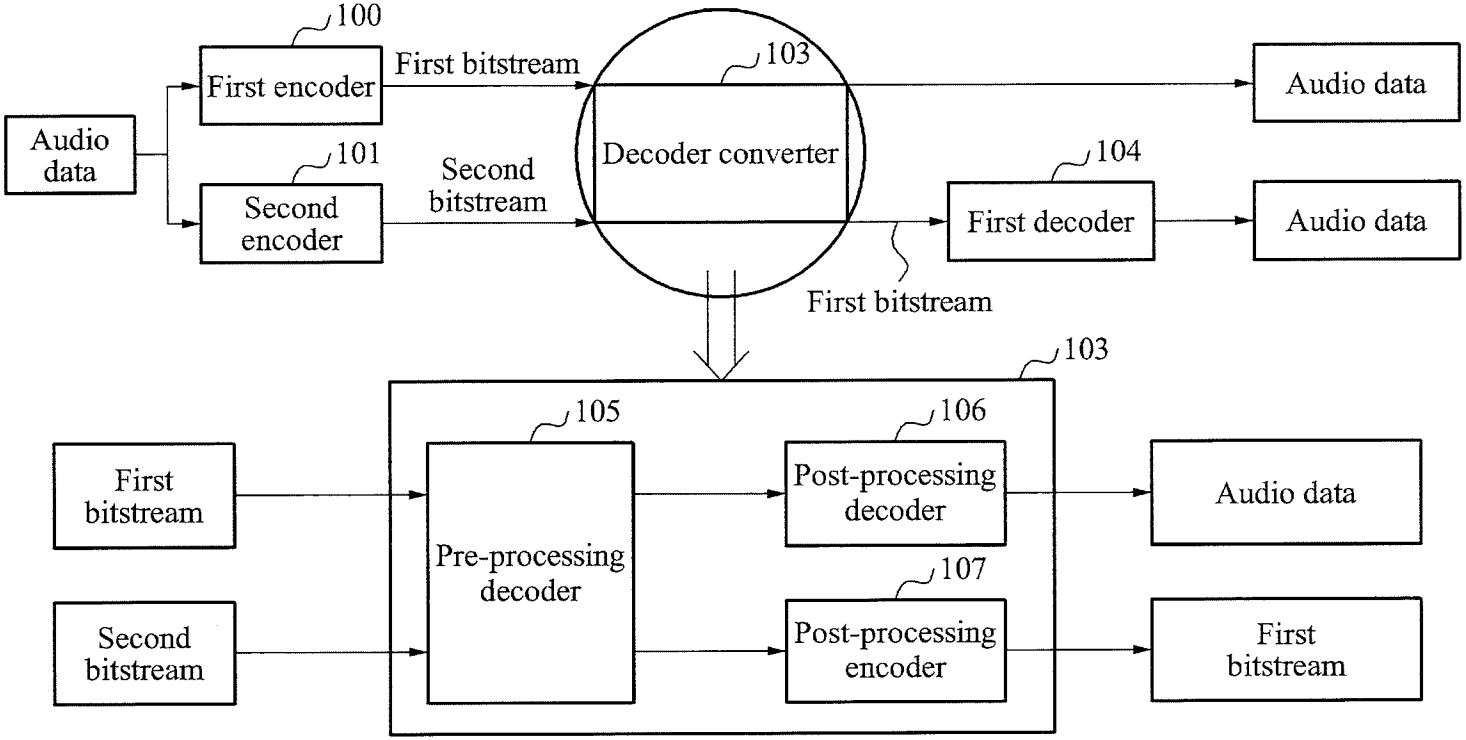
FIG. 1 illustrates a block diagram of an operation of a decoder converter, according to example embodiments.

Reference will now be made in detail to embodiments, examples of which are illustrated in the accompanying drawings, wherein like reference numerals refer to the like elements throughout. Embodiments are described below to explain the present disclosure by referring to the figures.

FIG. 1 illustrates an operation of a decoder converter 103, according to example embodiments.

The aforementioned general audio codec refers to a first decoder 104 of FIG. 1, and the enhanced audio codec refers to a first encoder 100 and a second encoder 101 of FIG. 1. The enhanced audio codec may include an additional function compared to the general audio codec, and a sound quality may be enhanced when compared to a sound quality having the same bit rate, and an enhanced extendable number of channels may process audio data.

Referring to FIG. 1, the decoder converter 103 may receive a first bitstream and a second bitstream from the first encoder 100 and the second encoder 101, respectively. Here, the first encoder 100 and the second encoder 101 may generate the first bitstream and the second bitstream, respectively, based on differing coding processes. In this instance, a sound quality of the second encoder 101 may be enhanced when compared to a sound quality of the general audio codec having the same bit rate, for example, the first encoder 100 and the first decoder 104. Further, the second encoder 101 may process audio data having a maximum extendable number of audio channels. To this end, the second encoder 101 may provide a plurality of additional incompatible functions compared to the first encoder 100 and the first decoder 104. In particular, the second encoder 101 may process the audio data of which a sound quality is enhanced compared to the general audio codec, for example, the first encoder 100 and the first decoder 104.

When a user terminal includes the first decoder 104 of the general audio codec process only, the user terminal may not process a bitstream generated by the enhanced audio codec because the enhanced audio codec includes additional functions that may be incompatible with the first decoder 104 of the general audio codec process. Therefore, the user terminal including the first decoder 104 may include the decoder converter 103 for converting the bitstream of the enhanced audio codec process to a bitstream of the general audio codec process in order to process the bitstream generated by the enhanced audio codec.

When the first bitstream generated by the first encoder 100 of the general audio codec is inputted to the user terminal including the decoder converter 103, the decoder converter 103 may decode the first bitstream via a pre-processing decoder 105 and a post-processing decoder 106 included in the decoder converter 103. Alternatively, the decoder converter 103 may bypass the first bitstream, and the user terminal may process the first bitstream generated by the general audio codec, via the first decoder 104.

When the second bitstream generated by the second encoder 101 of the enhanced audio codec is inputted to the user terminal, the decoder converter 103 may convert the second bitstream to the first bitstream processible by the general audio codec via the pre-processing decoder 105 and a post-processing encoder 107 and output the converted first bitstream. The user terminal may convert the second bitstream generated by the second encoder 101 of the enhanced audio codec to the first bitstream processible by the first decoder 104 of the general audio codec, via the decoder converter 103. The decoder converter 103 may decode the second bitstream to convert the second bitstream to the first bitstream.

For example, the first encoder 100 and the first decoder 104 may refer to Dolby Digital for processing audio data of a 5.1 channel via the general audio codec. The second encoder 101 may refer to Dolby Digital Plus for processing audio data of a 13.1 channel via the enhanced audio codec. In particular, the second encoder 101 may provide additional functions incompatible with the first encoder 100 and the first decoder 104, for example, transient pre-noise processing, enhanced channel coupling, adaptive hybrid transform (AHT) processing, spectral extension, and the like.

Dolby Digital may generate a Dolby Digital bitstream corresponding to the first bitstream. Also, Dolby Digital Plus may generate a Dolby Digital Plus bitstream corresponding to the second bitstream.

The Dolby Digital Plus bitstream may be converted to the Dolby Digital bitstream in the decoder converter 103. For example, a Dolby Digital decoder corresponding to the first decoder 104 may convert the converted Dolby Digital bitstream to a pulse-codec modulation (PCM) audio or decode the converted Dolby Digital bitstream directly to the PCM audio.

The Dolby Digital bitstream corresponding to the first bitstream may be bypassed in the decoder converter 103, or decoded directly in the decoder converter 103. The Dolby Digital decoder may convert the bypassed Dolby Digital bitstream to the PCM audio, or decode the bypassed Dolby Digital bitstream directly to the PCM audio.

For example, the decoder converter 103 may convert the Dolby Digital Plus bitstream, referred to as the bitstream generated by the enhance audio codec, to the Dolby Digital bitstream, referred to as the bitstream generated by the general audio codec, through decoding the Dolby Digital Plus bitstream.

As shown at the bottom of FIG. 1, the decoder converter 103 may include the pre-processing decoder 105, a post-processing decoder 106, and the post-processing encoder 107. The post-processing decoder 106 and the post-processing encoder 107 may be disposed at a back-end of the decoder converter 103.

The pre-processing decoder 105 may be disposed at a front-end of the decoder converter 103. The pre-processing decoder 105 may extract audio data of a frequency domain through decoding the second bitstream generated by the enhanced audio codec. In a subsequent step, the post-processing encoder 107 disposed at the back-end of the decoder converter 103 may generate the first bitstream processible in the general audio codec through re-encoding the audio data of the frequency domain outputted from the pre-processing decoder 105. As a result, the second bitstream generated by the enhanced audio codec may be converted to the first bitstream processible in the general audio codec by the decoder converter 103.

An apparatus for decoding audio data to be described hereinafter may refer to the pre-processing decoder 105 of FIG. 1. In particular, the apparatus for decoding the audio data may process audio data having an enhanced quality, and may be included in a decoder converter of a user terminal, or stand alone as an additional module.

Figure 2:
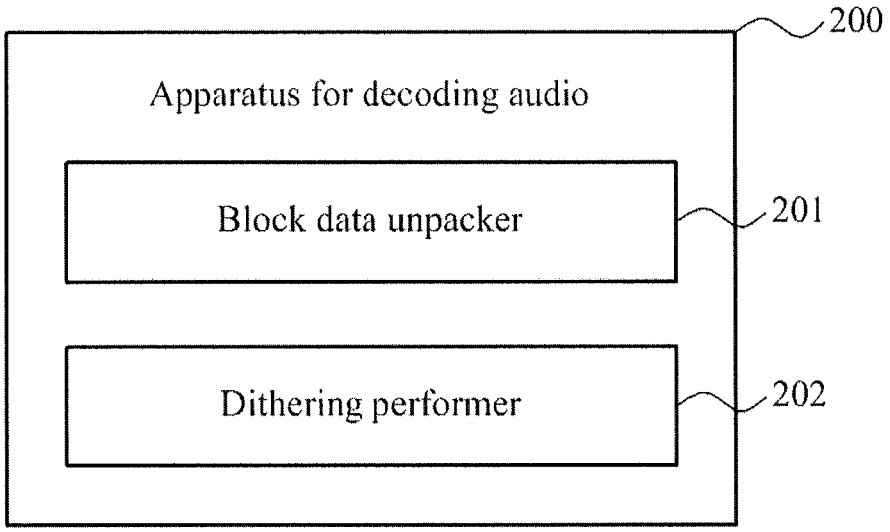
FIG. 2 illustrates an apparatus for decoding audio, according to example embodiments.

FIG. 2 illustrates a block diagram of an apparatus 200 for decoding audio data, according to example embodiments.

Referring to FIG. 2, the apparatus 200 for decoding the audio data may include a block data unpacker 201 and a dithering performer 202. The block data unpacker 201 may unpack block data included in a bitstream. The dithering performer 202 may perform dithering on the unpacked block data. In particular, the block data unpacking and the dithering may be separated in the apparatus 200 for decoding the audio data. The block data unpacker 201 and the dithering performer 202 may each include at least one processing device.

A single frame configuring a bitstream may be configured by a plurality of block data on a time axis, and configured by a plurality of channels to be mapped to a plurality of multi-channel speakers disposed in a space. Similarly, the dithering performer 202 may unpack the block data based on a nested loop configured by a loop based on a block and a loop based on a channel.

As an example, the block data unpacker 201 may extract an exponent and a mantissa representing block data from a bitstream based on a channel priority. In particular, the block data unpacker 201 may unpack the block data, through preferring the loop based on the channel to the loop based on the block. The block data unpacker 201 may extract the exponent and the mantissa corresponding to a plurality of channels in a single block, and then, from a subsequent block, extract the exponent and the mantissa corresponding to the plurality of channels.

For example, the dithering performer 202 may perform dithering based on a block priority. In particular, the dithering performer 202 may perform the dithering, through preferring the loop based on the block to the loop based on the channel. The dithering performer 202 may perform the dithering on a plurality of blocks in a single channel, and then perform the dithering on the plurality of blocks in a subsequent channel.

Hereinafter, operations of the block data unpacker 201 and the dithering performer 202 will be described in detail.

FIG. 3 illustrates a block-channel structure to be applied to an apparatus for decoding audio data, according to example embodiments.

A frame configuring a bitstream, according to example embodiments, may be configured by a plurality of blocks and a plurality of channels. In FIG. 3, the columns blk0, blk1, blk2 and so on may represent the blocks, and the rows ch0, ch1, ch2, and so on may represent the channels. The plurality of blocks may be allocated to a time axis in the frame, and the vertical axis may be configured by the plurality of channels to be mapped to a plurality of multi-channel speakers. For example, a block may be set in a transmission unit of a frequency value of audio data to unpack.

The apparatus for decoding the audio data may perform a bitstream searching process and a block data unpacking process through combining the two processes, and unpack a frequency spectrum of audio data. The bitstream searching may refer to searching for and storing a start location of a plurality of blocks in a bitstream. More particularly, the bitstream searching may refer to storing a pointer indicating the start location of a block at a packed exponent and a packed mantissa with respect to the bitstream.

The block data unpacking may refer to unpacking a frequency spectrum of audio data in an actual block unit, based on the start location of the block in the bitstream. In particular, the block data unpacking may refer to extracting the exponent and the mantissa of the block through unpacking the packed exponent and the packed mantissa.

Figure 4:
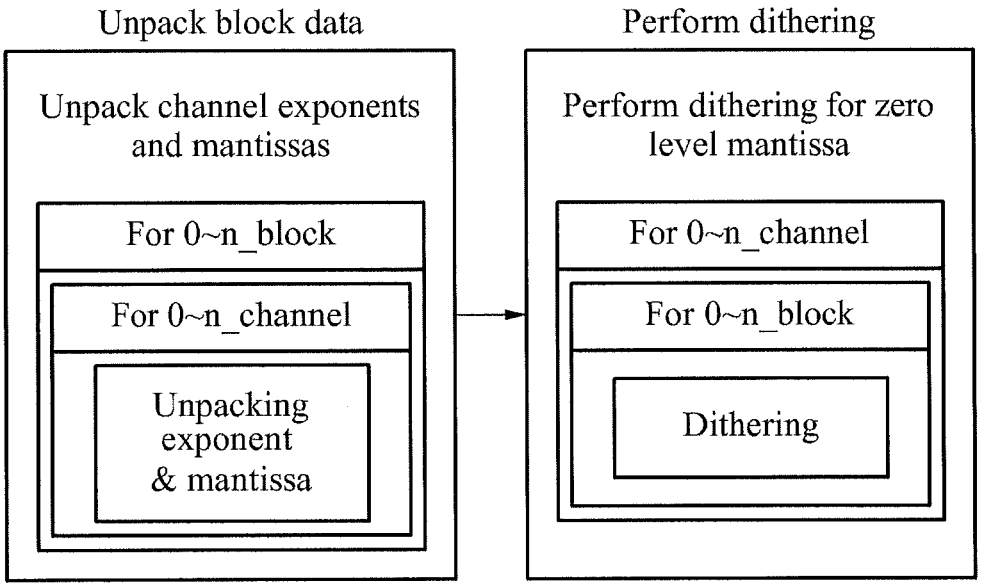
FIG. 4 illustrates an operation of performing block data unpacking and dithering included in an operation of audio decoding, according to example embodiments.

FIG. 4 illustrates performing block data unpacking and dithering included in an operation of audio decoding, according to example embodiments.

The bitstream searching and the block data unpacking may affect an overall complexity in a process of decoding audio data. Operations of the bitstream searching and the block data unpacking may overlap one another. By way of example, a memory for processing an instruction may increase due to the overlapping operations, and a number of accesses to the memory may increase. Additionally, the memory required may differ based on an order in which the block data unpacking is performed.

The apparatus for decoding the audio data may process the bitstream searching and the block data unpacking through combining the bitstream searching and the block data unpacking. The apparatus for decoding the audio data may process the bitstream searching through including the bitstream searching in the block data unpacking.

Referring to FIG. 4, the apparatus for decoding the audio data may unpack block data from a bitstream, through preferring a channel order to a block order. The block data unpacking may refer to unpacking an exponent and a mantissa representing block data from a bitstream.

The apparatus for decoding the audio data may perform dithering for generating noise temporarily when the unpacked mantissa has a value of "0". The dithering may be performed, through preferring the block order to the channel order, unlike the block data unpacking.

Figure 5:
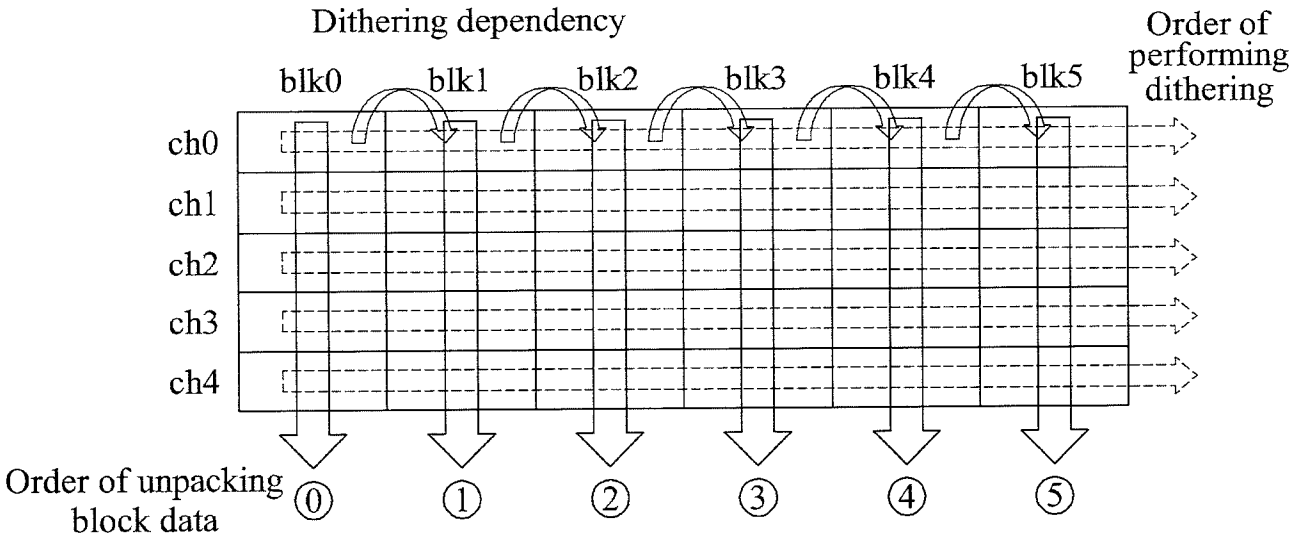
FIG. 5 illustrates an order of performing audio decoding, according to example embodiments.

FIG. 5 illustrates an order of performing audio decoding, according to example embodiments.

As discussed earlier, the block data unpacking may be performed, through preferring the channel order to the block order. Accordingly, referring to FIG. 5, the block data unpacking may be performed in a single frame, in a vertical direction. As used herein, "blk" refers to a block configuring a frame, and "ch" refers to a channel with reference to FIG. 5.

For example, the block data unpacking may be performed in a direction originating from a channel "0" towards a channel "4", based on a channel priority order. When processing of the block "0" (i.e. "blk0") is completed, the block data unpacking may be performed in the direction originating from the channel "0" towards the channel "4". Transitively, the block data unpacking in FIG. 5 may be performed in a frame in a vertical direction.

The dithering may be performed based on a block priority order. In particular, the dithering may be performed in a direction from a block "0" to a block "5" with respect to the Channel "0", and then from the block "0" to the block "5" with respect to a channel "1". Transitively, the dithering in FIG. 5 may be performed in a frame in a horizontal direction.

Hereinafter, a reason for separating the dithering from the block data unpacking will be discussed.

As described above, the block data unpacking may be performed in an adjacent channel unit rather than in an adjacent block unit when the bitstream searching and the block data unpacking are integrated into a single process. However, in dithering, a seed for generating a random number corresponding to noise may be determined with reference to the random number of an adjacent previous block. In particular, an order of performing the dithering may be determined unlike an order of performing the block data unpacking.

Block data may be unpacked in a sequential manner of B[0][0], B[1][0], B[2][0] when the block data refers to B[i][n], "i" referring to a channel index, and "n" referring to a block index. However, the seed for generating the random number for dithering may be transferred from an adjacent previous block. In particular, when performing the dithering on B[0][3], for example, a seed for dithering may be transferred from B[0][2]. Therefore, the dithering may be performed based on the block order rather than the channel order in a frame in a horizontal direction.

Accordingly, the apparatus for decoding the audio data may reduce complexity in decoding, through integrating the bitstream searching and the block data unpacking into a single process. The apparatus for decoding the audio data may prevent a decoding error due to dithering, through separating the block data unpacking and the dithering for processing based on different priority orders.

Figure 6:
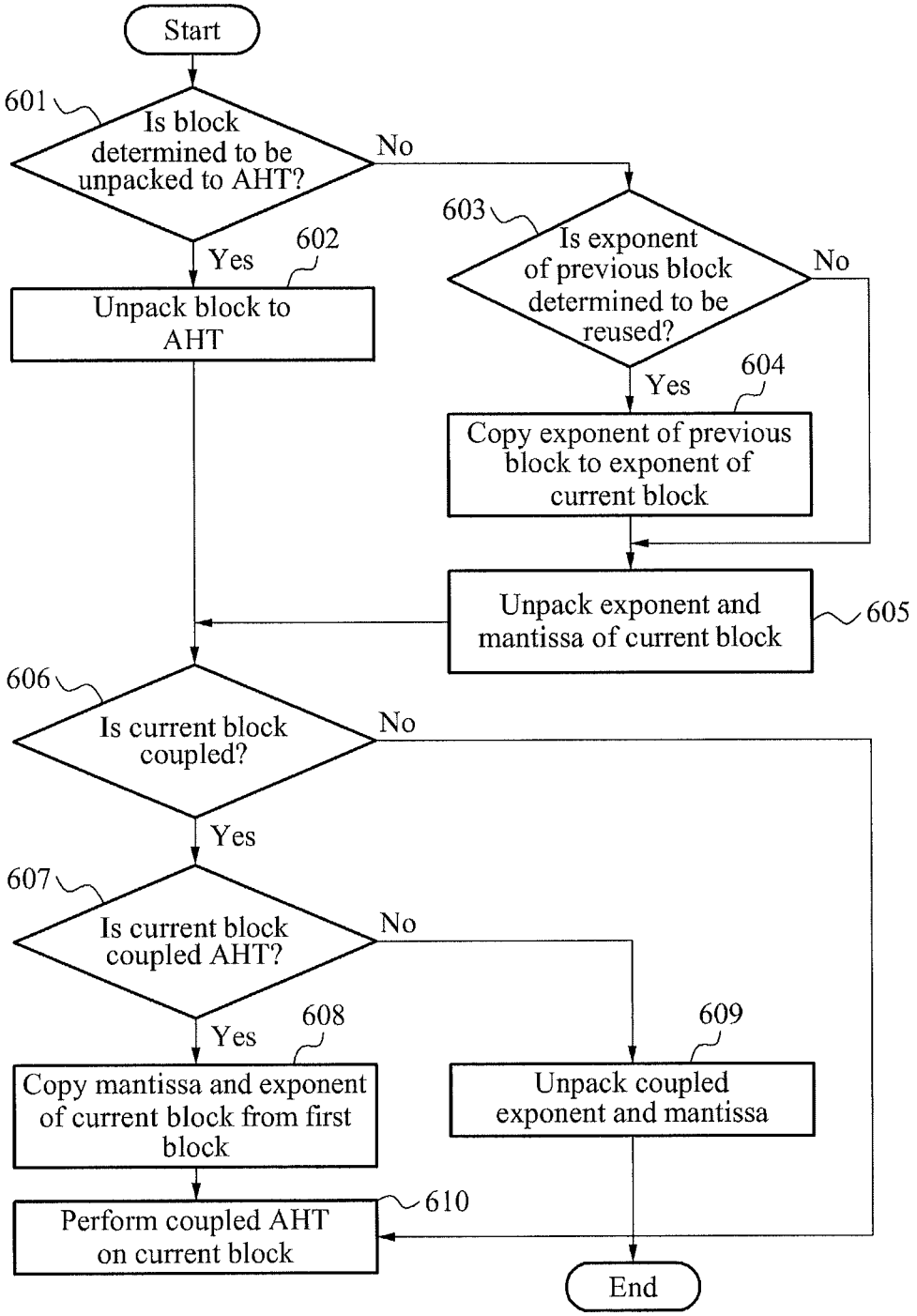
FIG. 6 is a flowchart illustrating a process of unpacking an exponent and a mantissa, according to example embodiments.

FIG. 6 illustrates a process of unpacking an exponent and a mantissa, according to example embodiments.

In particular, FIG. 6 illustrates the process of unpacking the exponent and the mantissa in FIG. 4. In operation 601, an apparatus for decoding audio data may determine whether to unpack a block to an adaptive hybrid transform (AHT). When the block is determined to be unpacked to AHT, the apparatus for decoding the audio data may unpack the block to the AHT, as in operation 602. When the block is determined not to be unpacked to the AHT, the apparatus for decoding the audio data may determine whether to reuse an exponent of a previous block with respect to a current block in operation 603. When the exponent of the previous block is determined not to be reused with respect to the current block, the apparatus for decoding the audio data may perform operation 605. Operation 605 may refer to a process of unpacking an exponent and a mantissa of a block, and will be discussed in detail with reference to FIG. 8.

Conversely, when the exponent of the previous block is determined to be reused with respect to the current block, the apparatus for decoding the audio data may determine the exponent of the current block through copying the exponent of the previous block to the exponent of the current block, as in operation 604. For example, the process of copying the exponent of the previous block to the exponent of the current block may be determined by Equation 1.

$$\exp[n][c]=\exp[n-1][c] \quad \text{[Equation 1]}$$

Here, "n" denotes a block index, and "c" denotes a channel index.

In operation 606, the apparatus for decoding the audio data may determine whether the current block is coupled. For example, the apparatus for decoding the audio data may extract, from a bitstream, information indicating whether the current block is coupled, and determine whether the current block is coupled. In this instance, when the current block is not coupled, the apparatus for decoding the audio data may end a whole process of the block data unpacking.

Otherwise, when the current block is coupled, the apparatus for decoding the audio data may determine whether the current block is a coupled AHT in operation 607. For example, the apparatus for decoding the audio data may extract, from a bitstream, information indicating whether the current block is the coupled AHT, and determine whether the current block is the coupled AHT.

For example, when the current block is determined to be the coupled AHT, the apparatus for decoding the audio data may copy a mantissa and an exponent of the current block from a block of a first channel in operation 608. Operation 608 may be performed by Equation 2.

$$\text{if } 0<c<5,\ n==0$$

$$\exp[n][c]=\exp[n][0],\ n=0,\ldots 5$$

$$\text{mant}[n][c]=\text{mant}[n][0],\ n=0,\ldots 5 \quad \text{[Equation 2]}$$

According to Equation 2, as an example, a number of channels is set to be five and a number of blocks is set to be five, without being limited thereto. In Equation 2, "exp" refers to an exponent, and "mant" refers to a mantissa.

When the current block is determined not to be the coupled AHT in operation 607, the apparatus for decoding the audio data may perform unpacking of a coupled exponent and mantissa in operation 609. In particular, the apparatus for decoding the audio data may unpack the exponent and the mantissa with respect to the coupled current block.

Subsequent to performing operation 608, the apparatus for decoding the audio data may perform a coupled AHT on the current block in operation 610. Operation 610 will be discussed in detail with reference to FIG. 9. In operation 609, the apparatus for decoding the audio data may perform the unpacking of the coupled exponent and mantissa. In this instance, the apparatus for decoding the audio data may determine an exponent and a mantissa of a previous channel of the current block through copying the exponent and the mantissa of the previous channel.

Figure 7:
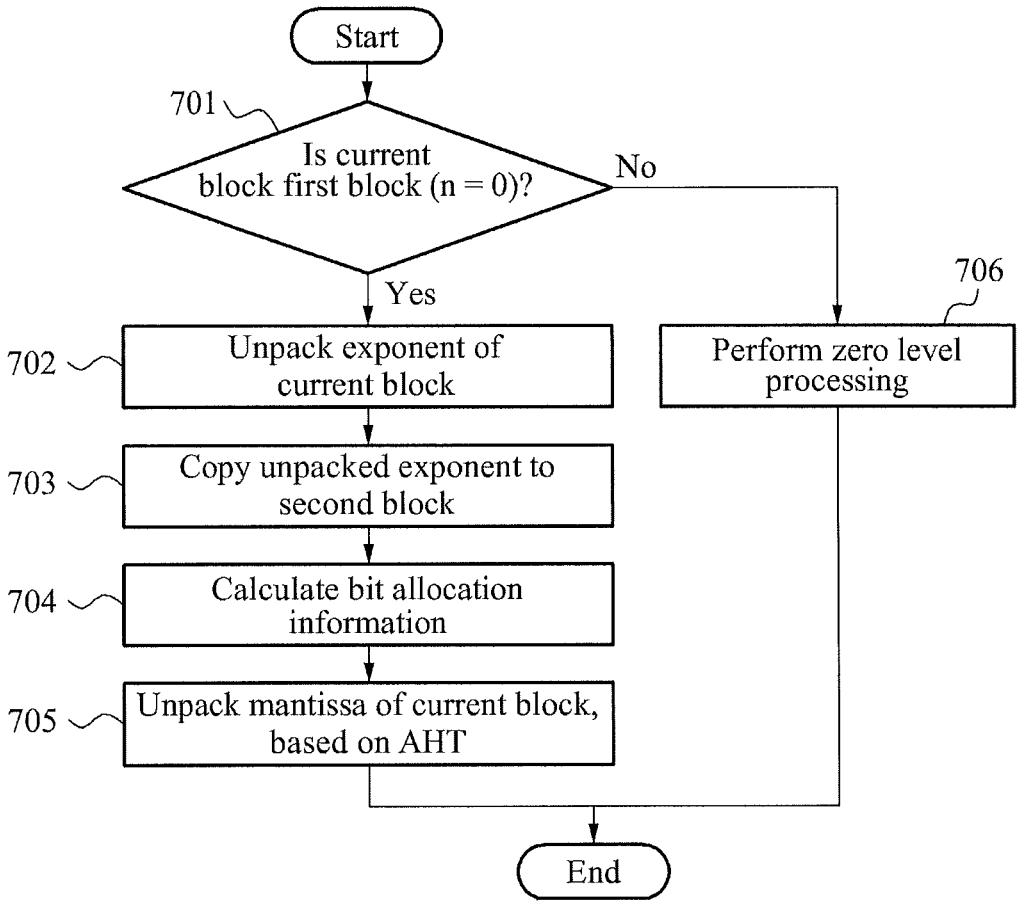
FIG. 7 is a flowchart illustrating a process of unpacking adaptive hybrid transform (AHT), according to example embodiments.

FIG. 7 is a flowchart illustrating a process of unpacking AHT, according to example embodiments.

In particular, FIG. 7 illustrates operation 602 of FIG. 6. In operation 701, an apparatus for decoding audio data may determine whether a current block is a first block, when "n=0". When the current block is determined to be the first block, the apparatus for decoding the audio data may unpack the exponent of the current block from a bitstream in operation 702. In operation 703, the apparatus for decoding the audio data may copy an exponent unpacked from the first block to a second block when the current block is the second block. Operation 703 may be performed continuously with respect to a plurality of blocks on the same channel. Operation 703 may be performed by Equation 3.

$$\exp[n][c]=\exp[0][c],\ n=1,\ldots,5 \qquad \text{[Equation 3]}$$

For example, "exp" refers to an exponent, "n" refers to a block index, and "c" refers to a channel index.

In operation 704, the apparatus for decoding the audio data may calculate bit allocation information, using the exponent unpacked with respect to the plurality of blocks, and store the bit allocation information in a buffer. For example, the bit allocation information may be used for an AHT.

In operation 705, the apparatus for decoding the audio data may unpack the mantissa of the current block, based on the AHT.

In operation 701, when the current block is not a first block, the apparatus for decoding the audio data may perform zero level processing, based on the bit allocation information calculated in the first block, in operation 706. For example, the apparatus for decoding the audio data may allocate, starting from a second block, a bit with respect to a mantissa representing a "0" bit, based on the bit allocation information calculated in a previous block.

Figure 8:
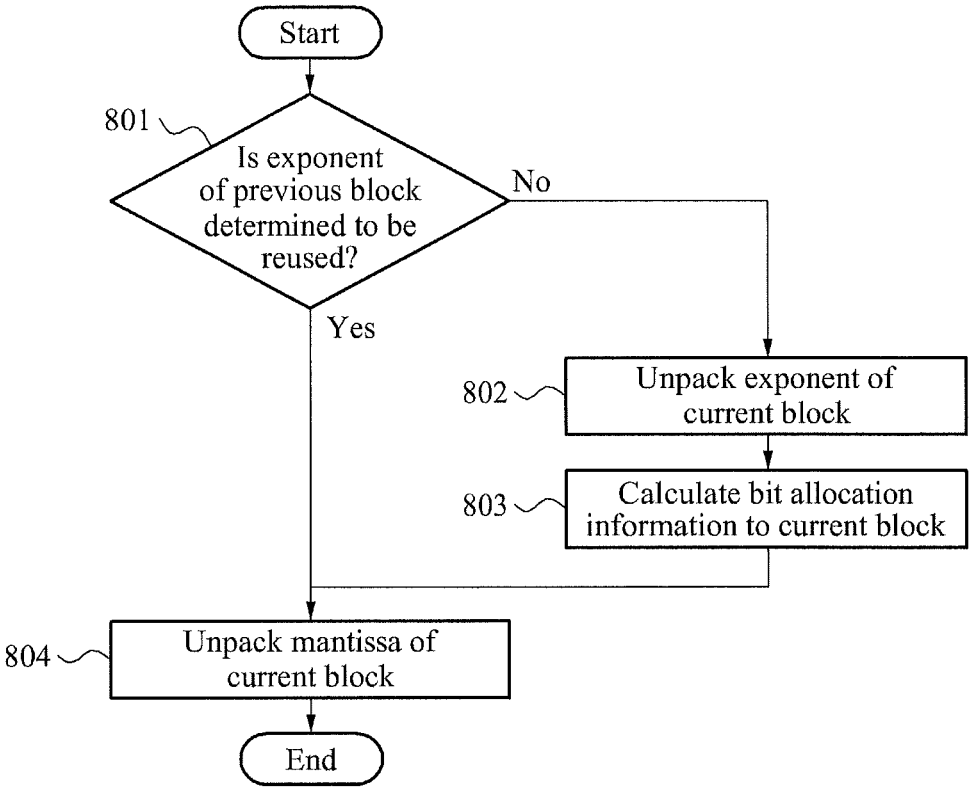
FIG. 8 is a flowchart illustrating a process of unpacking an exponent and a mantissa, according to example embodiments.

FIG. 8 is a flowchart illustrating a process of unpacking an exponent and a mantissa, according to example embodiments.

In particular, FIG. 8 details the unpacking in operation 605 of the exponent and the mantissa of the block in FIG. 6.

In operation 801, an apparatus for decoding audio data may determine whether to reuse an exponent of a previous block with respect to a current block. When the exponent of the previous block is determined not to be reused with respect to the current block, the apparatus for decoding the audio data may unpack an exponent of the current block and extract the exponent of the current block from a bitstream in operation 802. In operation 803, the apparatus for decoding the audio data may calculate bit allocation information of the current block, using the extracted exponent of the current block.

When the exponent of the previous block is determined to be reused with respect to the current block in operation 801, the apparatus for decoding the audio data may unpack a mantissa of the current block from a bitstream in operation 804.

Figure 9:
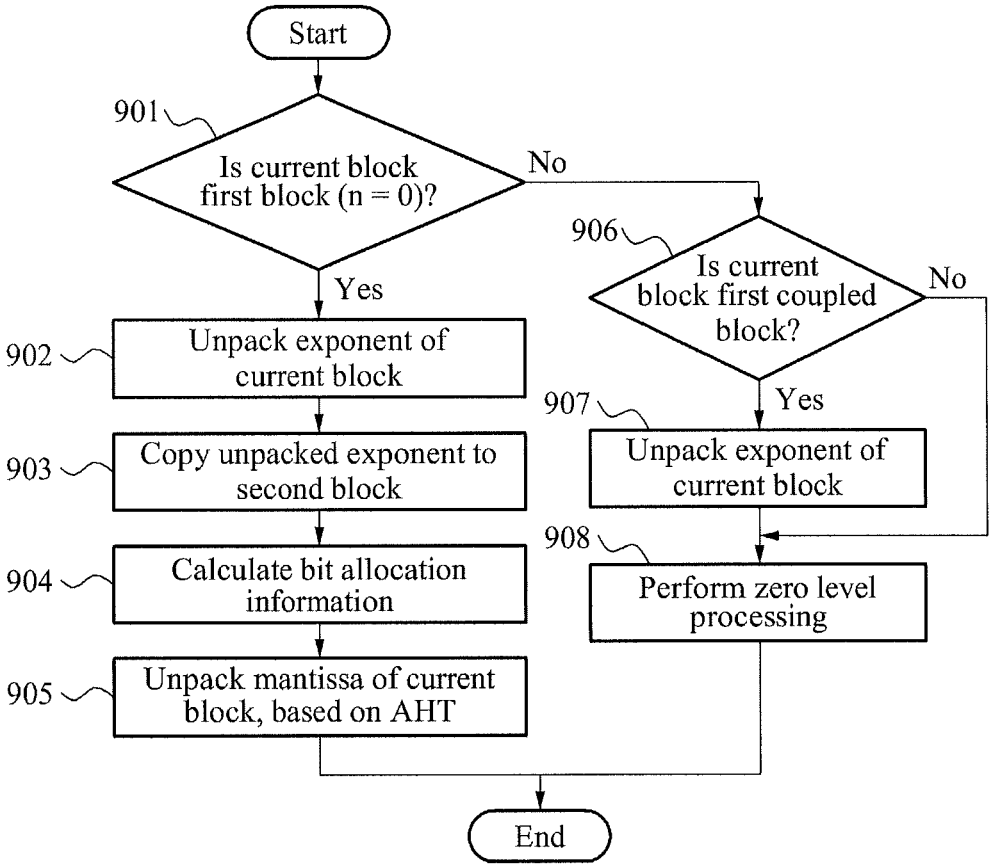
FIG. 9 is a flowchart illustrating a process of processing coupled AHT, according to example embodiments.

FIG. 9 illustrates a process of processing coupled AHT according to example embodiments.

In particular, FIG. 9 details operation 610 of FIG. 6. Operations 901 through 905 in FIG. 9 may be identical to operations 701 through 705 of FIG. 7, and thus repeated descriptions will be omitted here for conciseness and ease of description. Further, in another example embodiment, operations 901 through 905 may be selectively included or may include other steps not included in operations 701 through 705. That is, the present disclosure is not limited to operations 901 through 905 being identical to operations 701 through 705. In operation 906, an apparatus for decoding audio data may determine whether a current block is a first coupled block. When the current block is determined to be the first coupled block, the apparatus for decoding the audio data may unpack an exponent of the current block from a bitstream in operation 907. In operation 906, when the current block is determined not to be the first coupled block, the apparatus for decoding the audio data may perform operation 908.

In operation 908, when the current block is determined to be a second coupled block, the apparatus for decoding the audio data may perform zero level processing.

Figure 10:
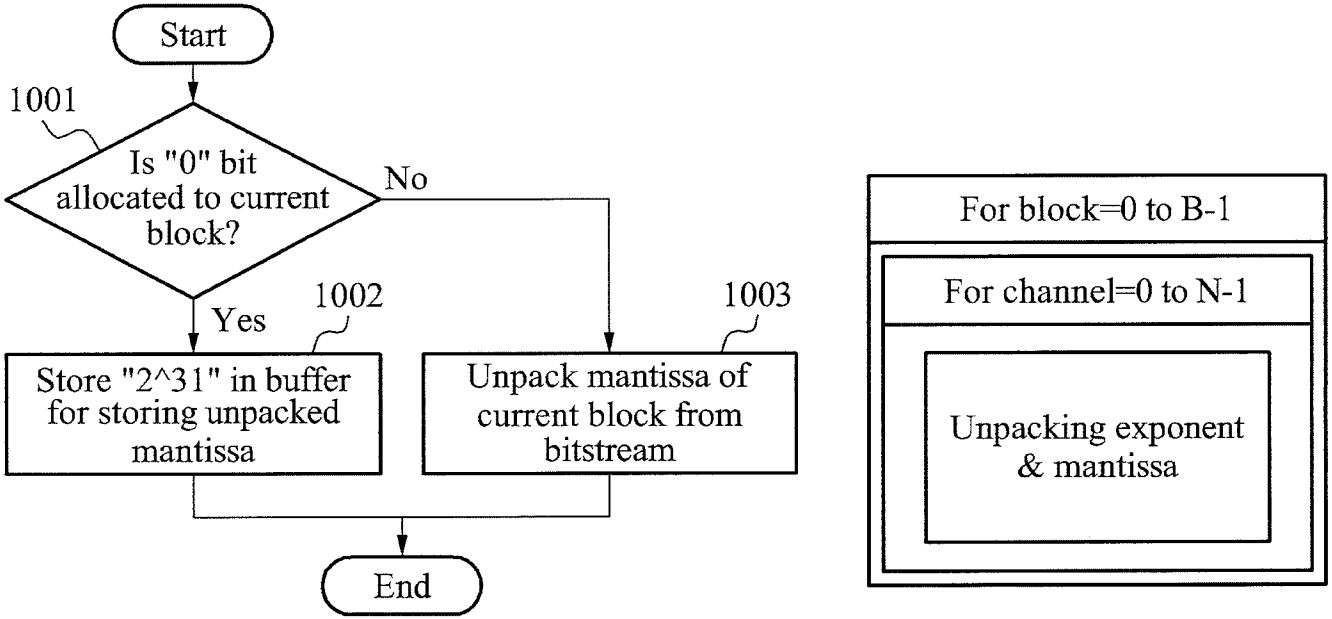
FIG. 10 illustrates a process of marking a frequency to which a "0" bit is allocated for dithering, according to example embodiments.

FIG. 10 illustrates a process of marking a frequency to which a "0" bit is allocated for dithering, according to example embodiments.

In particular, FIG. 10 illustrates a process of marking a frequency to which the "0" bit is allocated separately, prior to performing dithering.

In operation 1001, an apparatus for decoding audio data may determine whether the "0" bit is allocated to a current block. For example, the apparatus for decoding the audio data may determine whether the "0" bit is allocated to the current block, using bit allocation information. When the "0" bit is allocated to the current block, the apparatus for decoding the audio data may store "2^31" in a buffer for storing an unpacked mantissa of the current block as in operation 1002.

In this instance, for example, the apparatus for decoding the audio data may store "2^31 (1<<31)" in the buffer for storing the unpacked mantissa of the current block so as not to additionally allocate a buffer for marking a frequency of the current block to which the "0" bit is allocated. Here, "2^31" may refer to a value unobtainable by the frequency of the current block unpacked from a bitstream to be actually used.

When the "0" bit is not allocated to the current block, the apparatus for decoding the audio data may perform operation 1003, according to FIG. 8. For example, the apparatus for decoding the audio data may unpack the mantissa of the current block from the bitstream.

Figure 11:
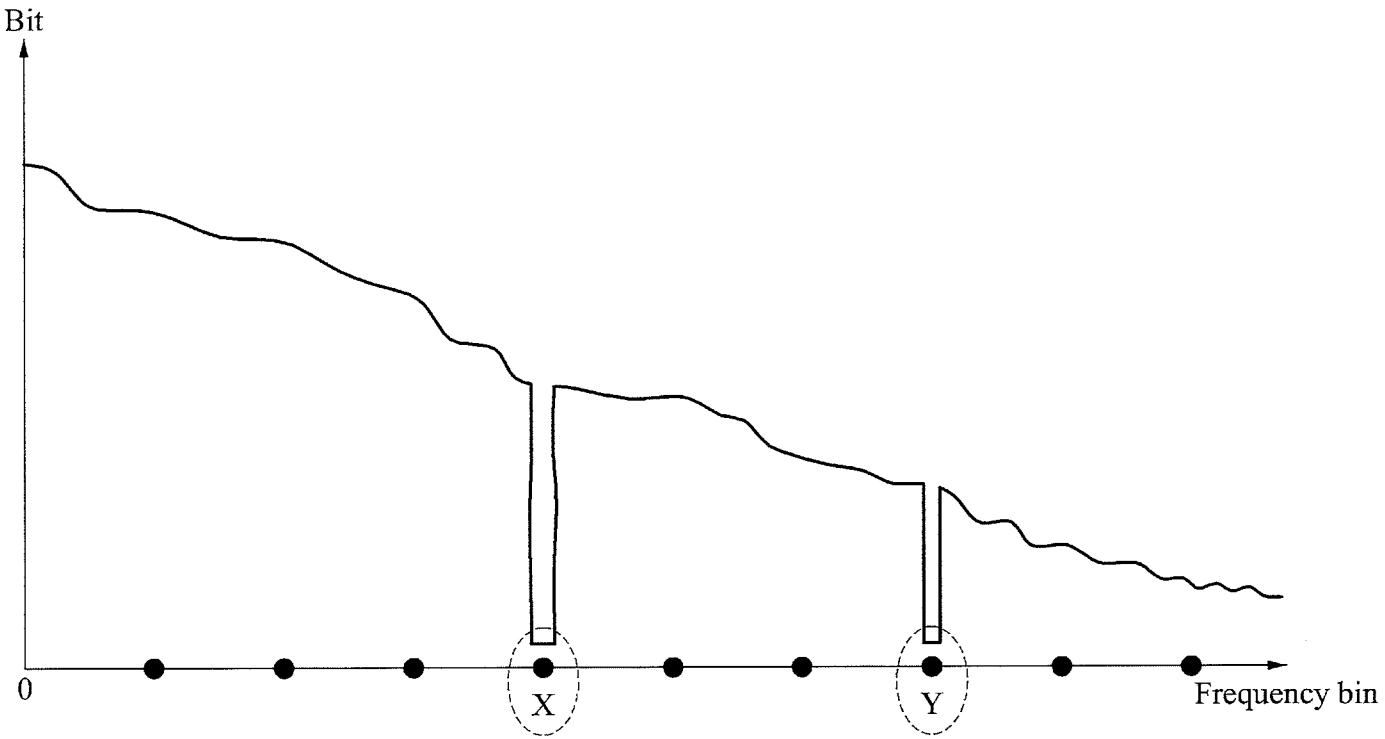
FIG. 11 illustrates an example of a frequency to which the "0" bit is allocated, according to example embodiments.

FIG. 11 illustrates an example of a frequency to which the "0" bit is allocated, according to example embodiments.

Referring to FIG. 11, a frequency of a current block to which the "0" bit is allocated refers to X and Y. For example, an apparatus for decoding the audio data may allocate "2^31" to a frequency to which the "0" bit is allocated. The apparatus for decoding the audio data may perform dithering through verifying the frequency to which "2^31" is allocated when the dithering is performed. As described above, the dithering may refer to generating noise, for example, a random number, of a predetermined size rather than "0" with respect to the frequency to which the "0" bit is allocated through a seed, in order to avoid deterioration in a quality of audio data.

Figure 12:
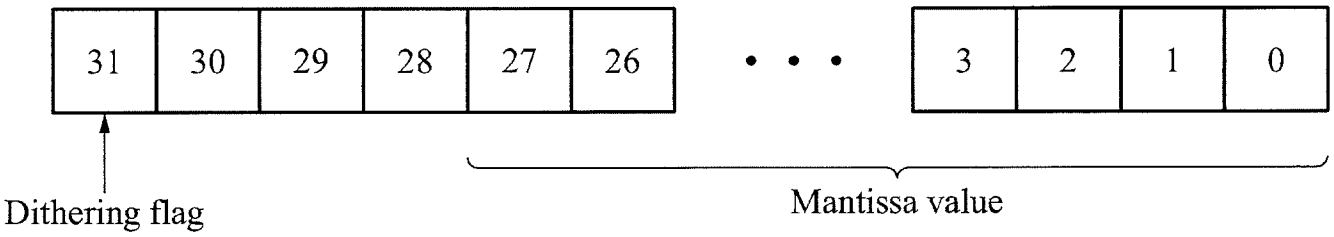
FIG. 12 illustrates a process of marking for dithering, according to example embodiments.

FIG. 12 illustrates a process of marking for dithering, according to example embodiments.

In particular, FIG. 12 illustrates a process of marking a bin of a frequency spectrum in which dithering is to be performed during block data unpacking. For example, the bin of the frequency spectrum in which the dithering is to be performed may refer to a bin of a frequency spectrum to which the "0" bit is allocated in FIG. 11.

For example, the apparatus for decoding the audio data may store a mantissa in "0~27" bits in a buffer. However, when the "0" bit is allocated to the bin of the frequency spectrum, the apparatus for decoding the audio data may determine the bin of the frequency spectrum to be an object to perform the dithering, and set "mantvalue" to be "1<<31" in the buffer for storing the mantissa. In particular, a flag for identifying whether the dithering is to be performed in the buffer for storing the mantissa may be set. For example, "mantvalue" to be stored in the buffer being "1<<31" may refer to deviating "mantvalue" of a mantissa of a current block extracted from a bitstream.

When "1<<31" is set in the buffer for storing the mantissa during the block data unpacking, the apparatus for decoding the audio data may perform the dithering through determining the bin of a corresponding frequency spectrum to be an object to perform the dithering.

Figure 13:
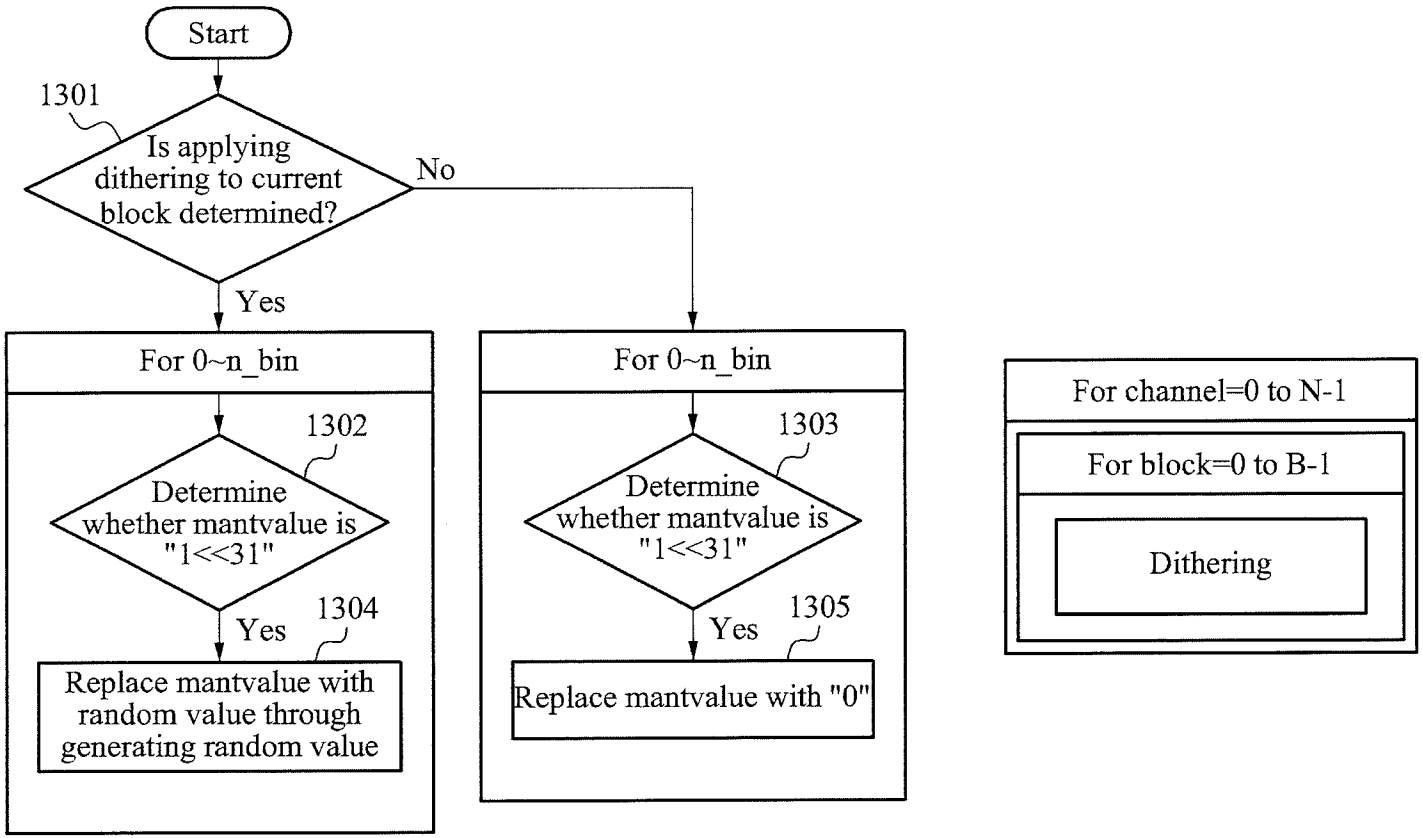
FIG. 13 illustrates a process of performing dithering, according to example embodiments.

FIG. 13 illustrates a process of performing dithering, according to example embodiments.

In operation 1301, an apparatus for decoding audio data may determine whether the dithering is to be performed on a current block. When the dithering is determined to be performed on the current block, the apparatus for decoding the audio data may determine whether a plurality of "mantvalues" of a frequency bin of the current block is "1<<31 (2^31)" as in operation 1302. For example, "mantvalue" refers to a mantissa stored in a buffer.

When the plurality of "mantvalues" of the frequency bin of the current block is "1<<31", the apparatus for decoding the audio data may perform the dithering through replacing "mantvalue" through generating a random value in operation 1304. For example, generating the random value may be determined through a seed transferred from a previous block. As an example, the random value may be generated based on a scheme for generating a random value defined in Dolby Digital Plus.

In operation 1301, when the dithering is determined not to be performed on the current block, the apparatus for decoding the audio data may determine whether the plurality of "mantvalues" of the frequency bin of the current block is "1<<31 (2^31)" as in operation 1303. In this instance, when the plurality of "mantvalues" of the frequency bin of the current block is determined to be "1<<31 (2^31)", the apparatus for decoding the audio data may replace "mantvalue" by "0" in operation 1305. The plurality of "mantvalues" of the frequency bin of the current block is determined not to be "1<<31 (2^31)", the apparatus for decoding the audio data may not perform any operations.

Figure 14:
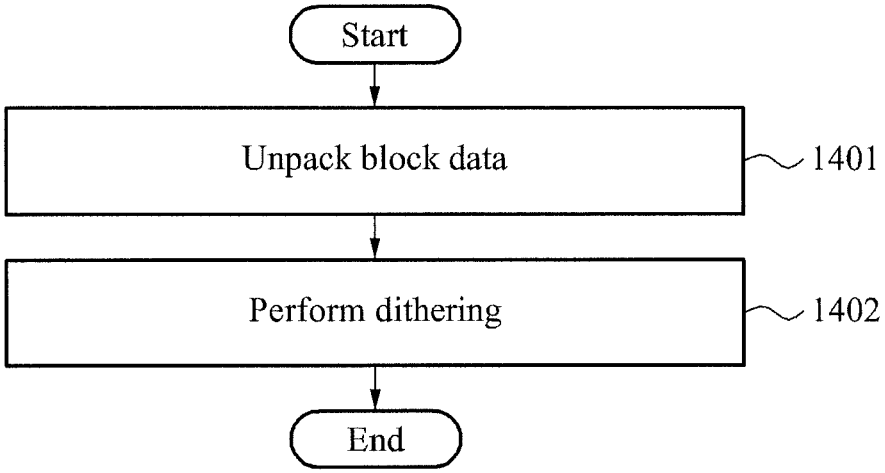
FIG. 14 is a flowchart illustrating a method for decoding audio data, according to example embodiments.

FIG. 14 is a flowchart illustrating a method for decoding the audio data, according to example embodiments.

In operation 1401, an apparatus for decoding audio data may unpack block data from a bitstream. As an example, the apparatus for decoding the audio data may reduce complexity in decoding, through processing bitstream searching and block data unpacking in an integrated single process, however, the present disclosure is not limited thereto.

In this instance, for example, the apparatus for decoding the audio data may unpack block data by preferring a channel to a block. For example, the block data unpacking may refer to unpacking an exponent and a mantissa representing block data.

In operation 1402, the apparatus for decoding the audio data may perform dithering. By way of example, the apparatus for decoding the audio data may perform the dithering, through preferring the block to the channel. For example, the apparatus for decoding the audio data may further flag an object to perform the dithering in a frequency bin of a current block.

A portable device as used throughout the present specification includes mobile communication devices, such as a personal digital cellular (PDC) phone, a personal communication service (PCS) phone, a personal handy-phone system (PHS) phone, a Code Division Multiple Access (CDMA)-2000 (1×, 3×) phone, a Wideband CDMA phone, a dual band/dual mode phone, a Global System for Mobile Communications (GSM) phone, a mobile broadband system (MBS) phone, a satellite/terrestrial Digital Multimedia Broadcasting (DMB) phone, a Smart phone, a cellular phone, a personal digital assistant (PDA), an MP3 player, a portable media player (PMP), an automotive navigation system (for example, a global positioning system), and the like. Also, the portable device as used throughout the present specification includes a digital camera, a plasma display panel, and the like.

The method for decoding audio according to the above-described embodiments may be recorded in non-transitory computer-readable media including program instructions to implement various operations embodied by a computer. The media may also include, alone or in combination with the program instructions, data files, data structures, and the like. Examples of non-transitory computer-readable media include magnetic media such as hard disks, floppy disks, and magnetic tape; optical media such as CD ROM discs and DVDs; magneto-optical media such as optical discs; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described embodiments, or vice versa.

Further, according to an aspect of the embodiments, any combinations of the described features, functions and/or operations can be provided.

Moreover, the apparatus for decoding audio, as described above, may include at least one processor to execute at least one of the above-described units and methods.

Although embodiments have been shown and described, it would be appreciated by those skilled in the art that changes may be made in these embodiments without departing from the principles and spirit of the disclosure, the scope of which is defined by the claims and their equivalents.

What is claimed is:

1. A non-transitory computer-readable medium having encoded thereon a plurality of instructions that, in response to being executed on a computing device, cause the computing device to perform a method comprising:

unpacking, by one or more processing devices, block data from a bitstream; and performing dithering with respect to the unpacked block data, wherein the unpacking of the block data comprises extracting an exponent and a mantissa corresponding to each of a plurality of channels from a current block, and, from a subsequent block of the current block, extracting an exponent and a mantissa corresponding to each of the plurality of channels.

2. The non-transitory computer-readable medium of claim 1, wherein the dithering is performed by preferring a block order over a channel order with respect to a frequency bin in which a "0" bit is allocated to the mantissa.

3. An apparatus for decoding audio data, the apparatus comprising:

a block data unpacker configured to unpack block data from a bitstream; and a dithering performer configured to perform dithering with respect to the unpacked block data, wherein the block data unpacker extracts an exponent and a mantissa corresponding to each of a plurality of channels from a current block, and, from a subsequent block of the current block, extracts an exponent and a mantissa corresponding to each of the plurality of channels.

4. The apparatus of claim 3, wherein the block data unpacker unpacks the block data, and the block data represents a frequency bin on which dithering is performed.

5. The apparatus of claim 4, wherein the block data unpacker stores a predetermined value in a buffer for storing an unpacked mantissa in order to represent a frequency bin on which the dithering is performed.

6. The apparatus of claim 3, wherein the dithering performer performs dithering through generating noise with respect to block data in which a "0" bit is allocated to a mantissa from among the unpacked block data.

7. The apparatus of claim 3, wherein the dithering performer performs dithering by preferring a block order over a channel order in a frame configuring a bitstream.

8. The apparatus of claim 3, wherein the dithering performer determines whether the current block is a block to which dithering is to be applied, and when the current block is determined to be the block to which the dithering is to be applied, the dithering is performed by assessing a mantissa of a plurality of frequency bins.

9. The apparatus of claim 3, wherein a decoding error due to dithering is prevented by separating the block data unpacking and the dithering for processing based on different priority orders.

10. A method for decoding audio data, the method comprising:

unpacking, by one or more processing devices, block data from a bitstream; and performing dithering with respect to the unpacked block data, wherein the unpacking of the block data comprises extracting an exponent and a mantissa corresponding to each of a plurality of channels from a current block, and, from a subsequent block of the current block, extracting an exponent and a mantissa corresponding to each of the plurality of channels.

11. The method of claim 10, wherein the performing of the dithering comprises:

determining whether the current block is a block to which dithering is to be applied, and when the current block is determined to be the block to which the dithering is to be applied, performing the dithering by assessing a mantissa of a plurality of frequency bins.

12. The method of claim 10, wherein the unpacking of the block data comprises:

unpacking the block data, the block data representing a frequency bin on which dithering is performed.

13. The method of claim 12, wherein the unpacking of the block data comprises:

storing a predetermined value in a buffer for storing an unpacked mantissa in order to represent a frequency bin in which the dithering is performed.

14. The method of claim 10, wherein the performing of the dithering comprises:

performing dithering by generating noise with respect to block data in which a "0" bit is allocated to a mantissa from among the unpacked block data.

15. The method of claim 10, wherein the performing of the dithering comprises:

performing dithering through preferring a block order over a channel order in a frame configuring a bitstream.

16. The method of claim 10, wherein the unpacking of the block data comprises:

unpacking an exponent and a mantissa representing the block data from a bitstream.

17. The method of claim 16, wherein the unpacking of the block data comprises:

unpacking an exponent and a mantissa representing block data by preferring a channel over a block in a frame configuring a bitstream.

18. The method of claim 16, further comprising, when an exponent of a previous block is determined to be reused, then the exponent of the previous block is copied to an exponent of a current block.

* * * * *